US011066931B2

(12) United States Patent
Thomas et al.

(10) Patent No.: US 11,066,931 B2
(45) Date of Patent: Jul. 20, 2021

(54) RETAINER DEVICE FOR A ROCK ANCHOR, ROCK ANCHOR SYSTEM AND ASSOCIATED INSTALLATION METHOD

(71) Applicant: Jusand Nominees Pty Ltd, Port Melbourne (AU)

(72) Inventors: Sam Thomas, Port Melbourne (AU); Gerry Noonan, Parkville (AU)

(73) Assignee: JUSAND NOMINEES PTY LTD, Port Melbourne (AU)

( * ) Notice: Subject to any disclaimer, the term of this patent is extended or adjusted under 35 U.S.C. 154(b) by 0 days.

(21) Appl. No.: 16/557,062

(22) Filed: Aug. 30, 2019

(65) Prior Publication Data

US 2020/0072051 A1 Mar. 5, 2020

(30) Foreign Application Priority Data

Aug. 31, 2018 (AU) ..... 2018223042
Mar. 28, 2019 (AU) ..... 2019202151

(51) Int. Cl.
*E21D 21/00* (2006.01)

(52) U.S. Cl.
CPC ..... *E21D 21/0093* (2013.01); *E21D 21/008* (2013.01)

(58) Field of Classification Search
CPC . E21D 21/004; E21D 21/0046; E21D 21/008; E21D 21/0093

(Continued)

(56) References Cited

U.S. PATENT DOCUMENTS 4,147,458 A * 4/1979 Elders ..... F16B 13/0875 405/259.1
4,453,845 A * 6/1984 Donan, Jr. ..... E21D 21/008 405/259.3

(Continued)

FOREIGN PATENT DOCUMENTS

CA 2740943 A1 * 2/2012 ..... E21D 21/008
DE 102011001271 A1 9/2012

(Continued)

*Primary Examiner* — Frederick L Lagman
(74) *Attorney, Agent, or Firm* — Richard T. Black; Foster Garvey PC

(57) ABSTRACT

The present invention provides a retainer device 1 for retaining or holding an anchor rod 11 of a rock anchor, especially a self-drilling anchor, in a hole H drilled above horizontal. The retainer device 1 comprises: a body portion 2 configured to be mounted on the anchor rod 11, and especially on an outer or external periphery of the anchor rod, and at least one locking arm or tab 6, 7 that projects from the body portion 2 in a direction transverse to a longitudinal extent of the anchor rod 11. The body portion 2 is configured for movement relative to the anchor rod 11 in use, and the at least one arm or tab 6, 7 is configured to deform so as to engage and bear against an inner wall W of the hole H when the retainer device 1 mounted on the anchor rod 11 is driven into the hole H. The invention also relates to a rock anchor system 10, comprising: at least one elongate anchor rod 11; a drill bit 12 configured for attachment to one end region 13 of the elongate anchor rod 11 for drilling the anchor rod 11 into rock strata R; and at least one retainer device 1 according to the invention described above for retaining or holding the anchor rod 11 in a hole H drilled in the rock strata R above horizontal. The invention also provides a method for installing a rock anchor.

30 Claims, 6 Drawing Sheets

(58) Field of Classification Search
USPC ..... 405/259.1
See application file for complete search history.

(56) References Cited

U.S. PATENT DOCUMENTS

| | | | | | |
|---|---|---|---|---|---|
| 5,984,588 | A * | 11/1999 | Ferrari | E21D 21/008 | 405/259.5 |
| 6,102,118 | A * | 8/2000 | Moore | E21B 17/1028 | 166/241.7 |
| 7,320,371 | B2 * | 1/2008 | Mocivnik | E21D 21/0053 | 175/57 |
| 8,087,850 | B2 * | 1/2012 | Craig | E21D 21/0046 | 405/259.1 |
| 8,556,542 | B2 * | 10/2013 | Horsch | E21B 10/42 | 175/325.2 |
| 2004/0165958 | A1 * | 8/2004 | McLaren | E21D 20/02 | 405/259.6 |
| 2005/0123361 | A1 * | 6/2005 | Robertson, Jr. | E21D 21/008 | 405/259.4 |
| 2011/0274504 | A1 * | 11/2011 | Spath | E21D 21/008 | 405/259.3 |
| 2012/0114426 | A1 * | 5/2012 | Kenny | E21D 21/008 | 405/259.4 |
| 2015/0204152 | A1 * | 7/2015 | Boehm | E21B 3/00 | 175/57 |
| 2016/0326873 | A1 * | 11/2016 | Skogseth | E21D 21/008 | |

FOREIGN PATENT DOCUMENTS

| | | | | |
|---|---|---|---|---|
| GB | 2073283 | * | 10/1981 | E21D 21/008 |
| JP | S56139399 | A | 10/1981 | |
| JP | H04350300 | A | 12/1992 | |

* cited by examiner

RETAINER DEVICE FOR A ROCK ANCHOR, ROCK ANCHOR SYSTEM AND ASSOCIATED INSTALLATION METHOD

PRIORITY CLAIM

This application claims priority from Australian Application Nos. 2018223042 filed Aug. 31, 2018, and 2019202151 filed Mar. 28, 2019; the above applications are hereby incorporated by reference in their entireties as if fully set forth herein.

FIELD OF THE INVENTION

The present invention relates to a retainer device for a rock anchor, and particularly for retaining or holding an anchor rod of a rock anchor in a rock bore drilled above horizontal during installation. The present invention also relates to a rock anchor system including such a retainer device and a method of installing a rock anchor.

Thus, it will be appreciated that the present invention has particular application or use in the mining industry, and it will be convenient to describe the invention herein in that exemplary context. It will be noted, however, that applications may also be contemplated in other fields, such as in the construction industry.

BACKGROUND OF THE INVENTION

In underground mine environments, a body or vein of ore will typically be accessed by excavating cavities into the rock strata below the ore body or vein and then working towards the ore deposit from below. This technique is referred to in the mining field as "overhand stoping" and has become the predominant direction of mining with the advent of rock blasting and power drills.

Depending on the quality of the rock strata excavated to access the ore body, the rock from which the underground cavities are excavated may need to be stabilised with rock anchors to render the underground environment safe against the risk of rock-fall or even partial or total collapse. A known and regularly employed technique for stabilising rock strata in underground mines is with the use of cable bolts and rock anchors.

A cable bolt is a somewhat flexible steel cable (e.g. of nominal 15 mm diameter) which is grouted into a drilled hole. The length of the cable bolt will typically range from about 4 m to about 15 m depending on the particular rock condition (6 m is typical) and is installed in holes drilled above horizontal (i.e. "up holes"). The process of cable bolting involves drilling a hole into the rock, inserting a cable bolt into the hole, fixing the cable bolt in the hole with a cement grout, waiting for the grout to cure (typically a 12 hour minimum cure time), then tensioning the cable with a hydraulic jack at the free end region of the cable outside the hole, and installing a plate and fixture at the external rock face. Cable bolts can be installed with a purpose built drill rig known as a "cabolter" or can be installed with a drill rig known as a "jumbo". Both methods are time consuming and, in the case of installing with a jumbo, have inherent safety risks associated with the process.

A self-drilling rock anchor is a known alternative to cable bolts and other types of rock anchors and comprises one or more hollow threaded anchor rod or bar (each typically 2.5 m or 3 m in length), a drill bit that is mounted on a distal end of the anchor rod or bar, a coupling to join two or more anchor rods or bars together, and a plate and nut. The process of installing such a self-drilling anchor (SDA) involves: drilling a hole or bore into the rock with the SDA (e.g. using a "jumbo" drill rig) via the drill bit mounted at the distal end of the anchor rod; attaching additional lengths of SDA anchor rod as required; leaving the SDA in the hole or bore and injecting resin through the hollow centre of the anchor into the hole to fix the anchor rod of the SDA in the hole; allowing the resin to cure (usually only a matter of 5 to 10 minutes); then optionally tensioning the anchor rod at the free or proximal end region of the anchor rod outside the hole, and installing a plate and nut fixture on the exposed end of the SDA at the rock face.

Due to the fact that the anchor rod of an SDA is inserted as the hole or bore is drilled, a more efficient installation process is possible. Because resin can be used in the relatively small annular cavity surrounding the SDA anchor rod in the hole (i.e. instead of cement grout) and the resin is injected through the anchor rod, a consistent and reliable delivery of resin (or grout) is possible and the very faster-acting resin makes the use of SDAs attractive. Thus, self-drilling anchors (SDAs) of the type described above have the potential to replace the cable bolts and other types of rock anchors in range of situations. A remaining problem, however, is associated with the use of SDAs in holes or bores drilled above horizontal (i.e. in "up holes"). In particular, where additional lengths or sections of anchor rod are required (which is often the case), the initial length of anchor rod drilled into the rock has a tendency to fall out of the hole under self-weight before another section can be coupled to it. For this reason, SDAs are less practical and/or less commonly employed in holes or bores drilled above horizontal.

In view of the above, it is an object of the present invention to provide a new rock anchor system and a method for installing a rock anchor, in a hole or bore drilled above horizontal.

SUMMARY OF THE INVENTION

According to one aspect, therefore, the present invention provides a retainer device for retaining or holding an anchor rod of a rock anchor, especially a self-drilling anchor, in a hole drilled above horizontal. The retainer device comprises: a body portion configured to be mounted on the anchor rod, especially on an outer or external periphery of the anchor rod, and at least one arm or tab that projects from the body portion in a direction transverse to a longitudinal extent of the anchor rod. The body portion is configured for movement relative to the anchor rod in use, and the at least one arm or tab is configured to deform so as to engage and bear against the inner surface of the hole when the retainer device mounted on the anchor rod is driven into the hole. In this way, when the at least one arm or tab deforms to engage and bear against the inner surface of the hole, it can operate to hold or "lock" the anchor rod in the "up-hole" such that it is not able to fall out under its self-weight. The at least one "arm or tab" is therefore also generally referred to herein as a "locking arm or tab". The retainer device may therefore enable safe and effective installation of an SDA in above horizontal holes.

In a preferred embodiment, the or each arm or tab is elongate and projects from the body portion transversely to the longitudinal extent of the anchor rod by a distance at least equal to a diameter of the anchor rod. The distance is preferably in the range of 2 to 10 times the diameter of the anchor rod, and more preferably in the range of 4 to 6 times the diameter of the anchor rod. The anchor rod will typically have a diameter in the range of about 20 mm to about 40 mm, and the at least one arm or tab will preferably project from the body portion by a distance in the range of about 100 mm to about 200 mm.

In a preferred embodiment, each arm or tab is formed as a strip- or pin-like element and it projects generally radially outwardly from the anchor rod in use. Thus, the at least one arm or tab has a substantially greater radial extent in its undeformed state than the diameter of the hole drilled for the anchor rod upon which the retainer device is mounted.

In a preferred embodiment, the at least one arm or tab is configured to deform resiliently and/or plastically to engage and bear against the inner surface of the hole when the retainer device mounted on the anchor rod is driven into the hole. Thus, if there is a plastic (i.e. permanent) deformation of the projecting arm or tab, there is preferably also at least some resilient deformation such that the arm or tab remains outwardly biased into engagement with the inner side of the hole. Such an outward bias assists the arm to support and hold the anchor rod in the drilled hole.

In a preferred embodiment, the body portion of the retainer device is, in use, configured for translational movement relative to the anchor rod along the longitudinal extent of the anchor rod. In this way, as the anchor rod of the SDA is rotated to drill the anchor rod into the rock strata to form a hole for receiving and securing the anchor rod, the retainer device is able to move relative to the anchor rod outside of the hole being drilled. For example, as the anchor rod progressively advances into the hole being drilled in the rock under the percussive and rotary action of a drill bit provided on the SDA, the retainer device may remain adjacent the outer rock face on the outer periphery of the anchor rod.

In one preferred embodiment, the body portion is configured for sliding translational movement along the anchor rod. In this regard, the body portion typically comprises a profile that does not substantially interfere with sliding translational movement along the outer or external periphery of the anchor rod, even if the outer or external periphery of the anchor rod presents a helical thread. In particular, the body portion may include or define a channel for receiving the anchor rod and an inner periphery of the channel has or presents the profile that is configured to allow sliding translational movement along the outer or external periphery of the anchor rod. For example, the body portion may be slidably received on the anchor rod via a clearance fit. In one example, the body portion may be configured as a sleeve member, wherein the profile comprises a generally cylindrical channel within the sleeve for receiving the anchor rod, the cylindrical channel being oversized with respect to an outer diameter of the anchor rod to provide such a clearance fit. In an alternative example, the cylindrical channel of the body portion may optionally be sized to engage lightly the outer or external periphery of the anchor rod (e.g. via a light friction fit or light interference fit) and yet may nevertheless be able to be slid in the axial direction along the anchor rod upon the application of a relatively low force.

In a preferred embodiment, the body portion is configured to be fixed or held against translational movement along the anchor rod when the retainer device mounted on the anchor rod is driven into the hole. In this way, the act of driving the anchor rod and the retainer device into the hole does not cause the retainer device to migrate along the length of the anchor rod. Instead, the body portion remains substantially fixed in the axial direction relative to the anchor rod, which thereby causes the at least one arm or tab to be deformed against the inner sides or walls of the drilled hole. In one possible embodiment, the body portion may include a clip or clamp mechanism that can be activated to grip the anchor rod against relative translational movement, and deactivated to release the anchor rod to allow relative translational movement. The clip or clamp mechanism may include a switch-type lever, a slide element, or a rotatable collar for activating and deactivating the clamp or, for example, a locking pawl. In another possible embodiment, an abutment is provided on the outer or external periphery of the anchor rod for engagement with the body portion to prevent its translational movement along the anchor rod. In this regard, the abutment may comprise a shoulder that projects radially from the outer or external periphery of the anchor rod. For example, the abutment or shoulder may comprise part of a coupling member that is configured to axially interconnect the anchor rod upon which the body portion of the retainer device is mounted with another anchor rod.

In another preferred embodiment, the body portion is, in use, configured for rotational movement relative to the anchor rod about the longitudinal axis thereof. The body portion preferably comprises a profile that is configured to receive and engage with an external helical thread formed on the outer periphery of the anchor rod. In this regard, the body portion may include or define a channel for receiving the anchor rod. An inner periphery of the channel preferably has or presents the said profile that is configured to engage with the external helical thread formed on the outer periphery of the anchor rod. In this regard, the inner periphery of the channel may include one or more elements (e.g. thread elements, as a type of internal thread) designed or configured to engage with the external helical thread on the outer periphery of the anchor rod.

In one particularly preferred embodiment, the body portion comprises a coil, especially a helical coil, having an inner diameter and coil pitch that substantially complement or match the helical thread formed on the external periphery of the anchor rod, such that the coil is configured to receive and engage with the helical thread of the anchor rod. In this embodiment, the body portion and/or the at least one arm or tab is/are comprised of steel, such as spring steel. For example, the coil may be formed from steel wire having a diameter in the range of about 3 mm to about 20 mm, preferably about 6 mm.

In a preferred embodiment, the at least one arm or tab comprises a plurality of arms or tabs that project in a direction transversely outwards from a longitudinal extent of the anchor rod. For example, a first arm or tab may project from one end region of the body portion, and a second arm or tab may project from an opposite end region of the body portion. In an alternative arrangement, the first and second tabs or arms may project transversely outwards from the same end region of the body portion of the retainer device. The tabs or arms provided at the same end region of the body portion are preferably arranged evenly spaced apart from one another, such that where there are two tabs or arms at the same end region of the body portion, they preferably project transversely outwards in generally diametrically opposed directions.

According to another aspect, the invention provides a rock anchor system, comprising: at least one elongate anchor rod; a drill bit configured for attachment to one end region of the elongate anchor rod for drilling the anchor rod into rock strata; and at least one retainer device according to any of the embodiments described above for retaining or holding the anchor rod in a hole drilled in the rock strata above horizontal.

In a preferred embodiment of the rock anchor system, the at least one elongate anchor rod comprises an external helical thread formed on the outer periphery of the anchor rod, and preferably over substantially the entire longitudinal extent of the anchor rod.

In a preferred embodiment, the anchor rod is hollow or includes a longitudinally extending channel or conduit for introducing cement grout or resin there-through into the hole drilled in the rock strata.

In a preferred embodiment of the rock anchor system, the at least one elongate anchor rod comprises a plurality of complementary anchor rods that are configured or adapted to be securely and non-rotatably joined or coupled together in substantial axial alignment. The at least one retainer device comprises a corresponding plurality of retainer devices. Adjacent anchor rods of the plurality of complementary anchor rods are preferably configured to be joined or coupled together in substantial axial alignment by a coupling member. Each coupling member may have a shoulder that extends or projects radially from the external periphery of the anchor rod. In this way, the coupling member shoulder may form an abutment for the body portion of the retainer device against translational movement along the anchor rod.

In a preferred embodiment, therefore, the rock anchor system comprises two or more elongate complementary anchor rods configured to be securely and non-rotatably joined or coupled together in substantial axial alignment by a coupling member provided between each pair of axially adjacent anchor rods. The drill bit is configured for attachment to a free or distal end region of a distalmost anchor rod for drilling the anchor rod assembly into rock strata, and a respective said at least one retainer device is provided to be mounted to each complementary anchor rod above the coupling member that joins it to an adjacent anchor rod. Again, each coupling member may have a shoulder that extends or projects radially from the outer periphery of the anchor rod to form an abutment for the body portion of the retainer device against translational movement of the retainer device along the respective anchor rod.

The rock anchor system will desirably comprise a tensioning assembly located at an opposite end region of the anchor rod/anchor rod assembly to the drill bit. The tensioning assembly may include one or more plates and nuts for securing the tensioned anchor rods at the rock face.

According to a further aspect, the present invention provides a method of installing a rock anchor in rock strata, the rock anchor comprising an elongate anchor rod having a drill bit attached at one end region thereof, the method comprising steps of:

mounting a retainer device on an outer periphery of the anchor rod, the retainer device having at least one arm or tab that projects in a direction transverse to a longitudinal extent of the first anchor rod, wherein the retainer device is translationally movable relative to the anchor rod along a longitudinal extent of the anchor rod; and rotating the anchor rod with the drill bit to drill the anchor rod into the rock strata to form a hole for receiving and securing the anchor rod;

whereby, as the anchor rod advances into the hole by drilling, the retainer device mounted thereon is driven into the drilled hole, and whereby the at least one arm or tab deforms to engage and bear against an inner surface of the hole for retaining or holding the anchor rod in the hole.

In a preferred embodiment, the method comprises: providing an abutment at an opposite end region of the anchor rod for engagement with the retainer device as the anchor rod advances into the hole thereby to drive or push the retainer device into the drilled hole as the anchor rod advances into the hole during drilling.

In a preferred embodiment, the method comprises: attaching a coupling member at the opposite end region of the anchor rod for securely and non-rotatably joining or coupling a second elongate anchor rod in substantial axial alignment with the said anchor rod having the drill bit, wherein the coupling member presents the abutment for the retainer device.

In a preferred embodiment, the method further comprises steps of:

securely and non-rotatably joining or coupling a second elongate anchor rod to a proximal end of the anchor rod driven into the drilled hole in substantial axial alignment therewith;

mounting a second retainer device on an outer periphery of the second anchor rod, the second retainer device having at least one arm or tab that projects in a direction transverse to a longitudinal extent of the second anchor rod; and rotating the securely joined or coupled anchor rods to drill the anchor rods into the rock strata to extend the hole for receiving and securing the anchor rods, whereby, as the anchor rods advance into the hole during drilling, the second retainer device is driven into the drilled hole, whereby the at least one arm or tab of the second retainer device deforms to engage and bear against an inner surface of the hole for retaining or holding the anchor rods in the hole.

According to yet a further aspect, the present invention provides a method of installing a rock anchor in rock strata, comprising steps of:

mounting a retainer device on an outer periphery of an elongate anchor rod of the rock anchor, the retainer device having at least one arm or tab that projects in a direction transverse to a longitudinal extent of the anchor rod;

attaching a drill bit to one end of the anchor rod and rotating the anchor rod to drill the anchor rod into the rock strata to form a hole for receiving and securing the anchor rod, the retainer device being movable relative to the anchor rod outside of the hole; and driving the anchor rod and the retainer device mounted thereon into the drilled hole, whereby the retainer device is fixed or held against movement along the anchor rod as the anchor rod and retainer device are driven into the hole, and whereby the at least one arm or tab deforms to engage and bear against an inner surface of the hole for retaining or holding the anchor rod in the hole.

In a preferred embodiment, the method comprises the step of retracting the anchor rod from the drilled hole before driving the anchor rod and the retainer device mounted thereon into the drilled hole. The step of retracting the anchor rod from the drilled hole preferably includes reversing rotation of the anchor rod as the anchor rod is retracted.

In a preferred embodiment, the step of driving the anchor rod and retainer device mounted thereon into the drilled hole involves an essentially linear or axial movement into the hole.

In a preferred embodiment, the retainer device is movable relative to the anchor rod outside of the hole during the step of retracting the anchor rod from the drilled hole.

In a preferred embodiment, the outer periphery of the anchor rod has a helical thread. The helical thread is preferably over substantially the entire longitudinal extent of the anchor rod. The retainer device preferably includes a body portion that is configured to receive and engage with the helical thread on the outer periphery of the anchor rod. The at least one arm or tab of the retainer device projects from the body portion in the direction transverse to the longitudinal extent of the anchor rod.

In a preferred embodiment, the method further comprises steps of:

mounting a second retainer device on an outer periphery of a second elongate anchor rod, the second retainer device having at least one arm or tab that projects in a direction transverse to a longitudinal extent of the second anchor rod;

securely coupling the second anchor rod to a proximal end of the anchor rod driven into the hole, whereby the anchor rods are in substantial axial alignment, rotating the securely coupled anchor rods to drill the anchor rods further into the rock strata to extend the hole for receiving and securing the anchor rods, the second retainer device being movable relative to the second anchor rod outside of the hole; and driving the second anchor rod and the second retainer device mounted thereon into the hole, whereby the second retainer device is fixed or held against axial movement along the second anchor rod as the second anchor rod and second retainer device are driven into the hole, and whereby the at least one arm or tab deforms to engage and bear against the inner surface of the hole for retaining or holding the coupled anchor rods in the hole.

In a preferred embodiment, the second retainer device is movable relative to the second anchor rod outside of the hole during the step of retracting the coupled anchor rods from the drilled hole. Preferably, the method comprises a step of retracting the anchor rods from the drilled hole before driving the second anchor rod and second retainer device mounted thereon into the drilled hole.

According to yet another aspect of the present invention, there is provided a method of installing a rock anchor in rock strata, wherein the rock anchor includes a drill bit attached to one end region of an anchor rod, a coupling member having a shoulder extending radially beyond an outer periphery of the anchor rod, and a retainer device mounted to an outer periphery of the anchor rod between the shoulder and the drill bit, the retainer device having at least one arm or tab that projects in a direction transverse to a longitudinal extent of the anchor rod, the method comprising:

rotating the anchor rod to drill the anchor into the rock strata to form a hole for receiving and securing the anchor rod, wherein as the anchor rod advances into the hole, a portion of the retainer device abuts against the shoulder thereby pushing the retaining device into the hole.

Preferably, the method further comprises: mounting a second retainer device on an outer periphery of the second elongate anchor rod, the second retainer device having at least one arm or tab that projects in a direction transverse to a longitudinal extent of the second anchor rod; securely coupling the second anchor rod to a proximal end of the anchor rod driven into the hole such that the second retainer device locates between the coupling member and a second coupling member attached to the second anchor rod and having a shoulder extending radially beyond an outer periphery of the second anchor rod; and, rotating the anchor rod to drill the anchor into the rock strata to extend the hole for receiving and securing the anchor rod, wherein as the anchor rod advances into the hole, a portion of the second retainer device abuts against the second shoulder thereby pushing the second retainer device into the hole.

The retainer device and rock anchor system according to preferred embodiments of the invention may thus enable safe and effective installation of a self-drilling anchor (SDA) in above horizontal holes and thereby provide an effective alternative to the use of cable bolts and other types of rock anchors in "up-holes". It will be noted that this may potentially provide a more efficient installation process and/or a substantial time saving, with SDAs typically able to be installed in about half the time required for traditional cable bolts. Furthermore, SDAs are well-suited to installation with a "jumbo" drill rig, which may have some operational and/or safety advantages compared to traditional cable bolting.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference signs designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will also be understood that certain actions and/or steps in an embodiment of a method may be described or depicted in a particular order of occurrences while those skilled in the art will understand that such specificity with respect to sequence is not actually required.

DETAILED DESCRIPTION OF PREFERRED EMBODIMENTS

Figure 1:
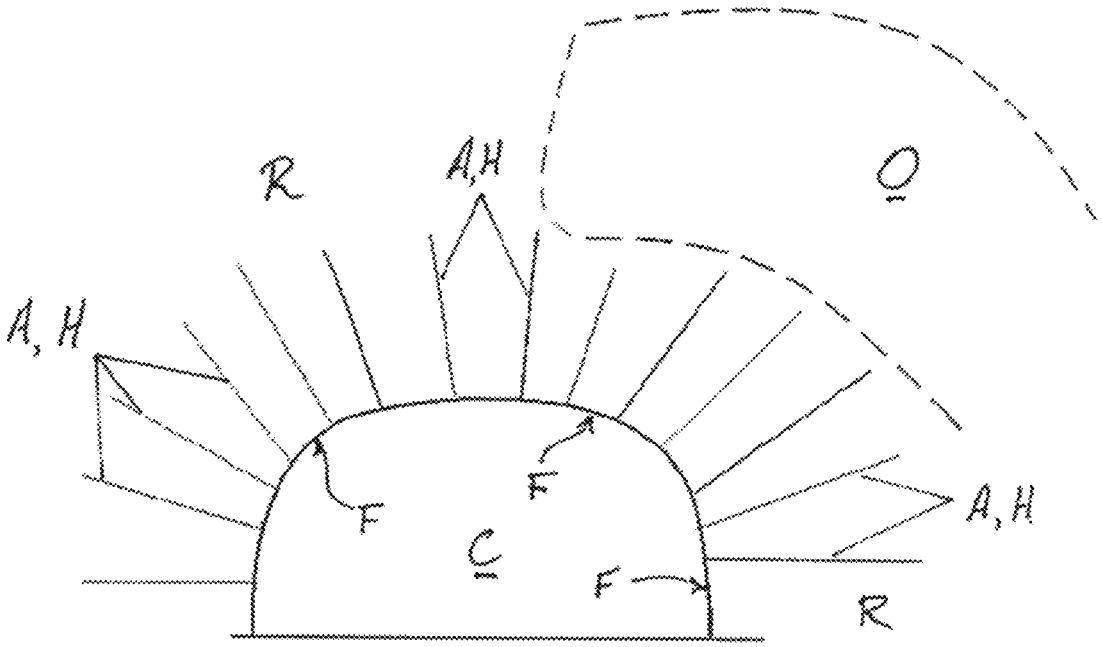
FIG. 1 is a schematic cross-sectional view of an excavated cavity in a mine environment illustrating rock anchors installed in rock strata to stabilise the rock strata.

Referring firstly to FIG. 1 of the drawings, a cross-sectional view of a mine environment is illustrated schematically. An excavated cavity or chamber C of the mine is shown in a cross-section taken normal or transverse to a length of that cavity or chamber C into the page. The cavity C is essentially surrounded by rock strata R and an ore deposit O above and displaced into the page from the cavity C can also be seen. The cavity C has been excavated to provide access for workers and equipment into the vicinity of the ore body O. Where the rock strata R surrounding the cavity C is unstable and liable to rock-fall or even partial collapse, rock anchors A can be employed to stabilise the rock strata R to render the underground environment safe for personnel and equipment. To this end, the rock anchors A are set in holes H that are drilled from the cavity C from an outer rock face F into the rock strata R. The holes H drilled and the rock anchors themselves are typically in the range of about 5 to 15 metres long.

Figure 2:
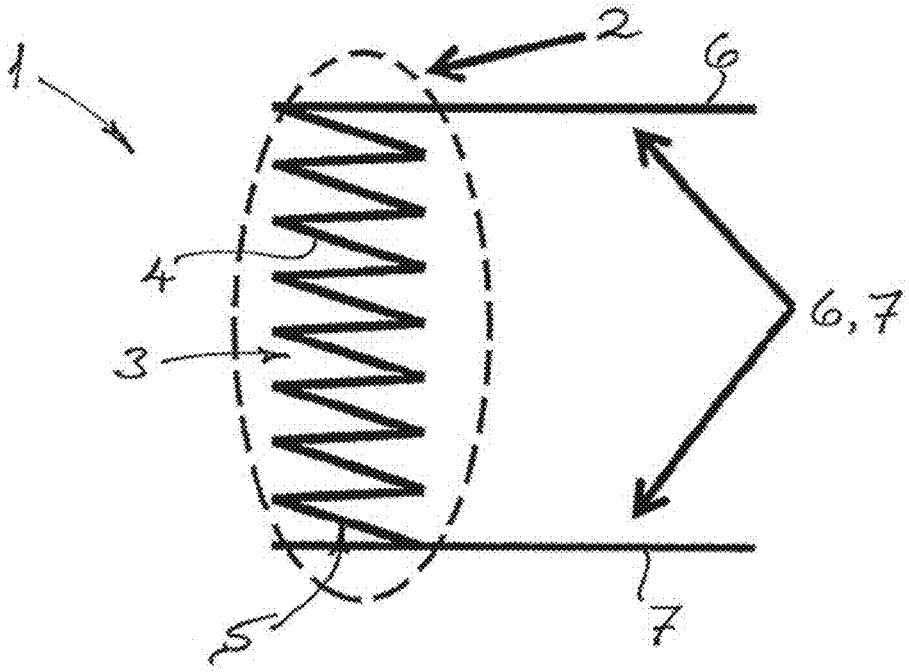
FIG. 2 is a schematic side view of a retainer device for retaining or holding an anchor rod of a rock anchor according to a preferred embodiment of the invention.
Figure 3:
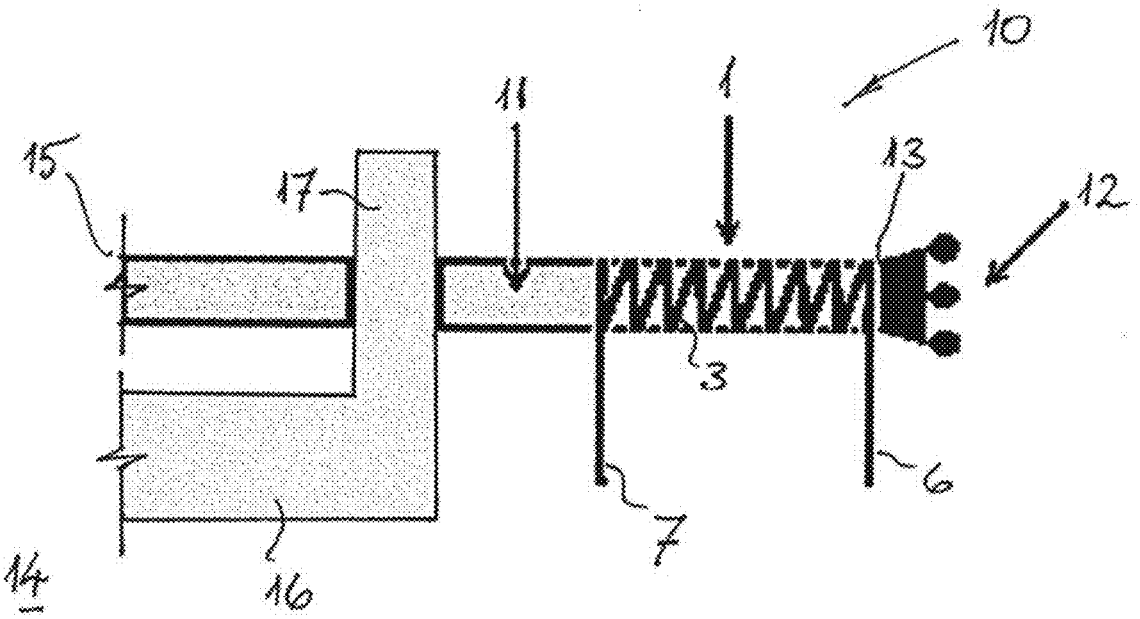
FIG. 3 is a schematic side view of a rock anchor system according to a preferred embodiment of the invention, including a retainer device as shown in FIG. 2.

With reference now to FIGS. 2 and 3 of the drawings, a retainer device 1 and a rock anchor system 10 including the retainer device 1 according to a preferred embodiment are shown schematically. The retainer device 1 comprises a body portion 2 (shown circled in FIG. 2) that is configured to be mounted on an outer or external periphery of an anchor rod 11 of the rock anchor system 10, as seen in FIG. 3. To this end, the body portion 2 comprises a helical coil 3 formed of steel wire 4 having a diameter of about 5 to 8 mm. In this way, the body portion 2 defines a channel 5 within the helical coil for receiving the anchor rod 11. An inner periphery of the channel 5 presents a profile that is configured to engage with an external helical thread (not shown) formed on the outer periphery of the anchor rod 11. In particular, the helical coil 3 has an inner diameter and coil pitch that complement or match the helical thread formed on the external periphery of the anchor rod, such that the coil is configured to receive and engage with the helical thread of the anchor rod 11 when the body portion 2 of the retainer device 1 is screwed onto the anchor rod.

Referring still to FIGS. 2 and 3, the retainer device 1 further comprises two locking arms or tabs 6, 7 that project outwardly from the body portion 2 or coil 3 in a direction transverse to a central axis of the channel 5 for receiving the anchor rod 11. Thus, the two arms or tabs 6, 7 are configured to project transverse to a longitudinal extent of the anchor rod 11. In particular, the two locking arms or tabs 6, 7 comprise a first arm or tab 6 that projects or extends from one end region of the body portion coil 3, and a second arm or tab 7 that projects or extends from an opposite end region of the body portion coil 3. Each of the arms or tabs 6, 7 is formed from the same wire as the helical coil 3, and is effectively a tail or end length of that steel wire.

As noted above, when in use in the rock anchor system 10, the retainer device 1 can be readily screwed onto the outer periphery of the externally threaded anchor rod 11, as seen in FIG. 3, because the channel 5 formed by the helical coil 3 of the body portion 2 has an inner profile that generally complements the external thread on the anchor rod 11. A drill bit 12, and especially a sacrificial drill bit, is typically then secured at a distal end 13 of the elongate anchor rod 11 adjacent the retainer device 1, as shown in FIG. 3. During use, the rock anchor system 10 including the retainer device 1 may be installed using a hydraulic drilling rig 14 known as a "jumbo" rig. A proximal end 15 of the elongate anchor rod 11 is operatively coupled to the drilling rig 14 so that the drilling rig 14 can impart both rotary and percussive motion to the anchor rod 11 and thus also to the drill bit 12. The elongate anchor rod 11 with the drill bit 12 securely attached at the end thereof is supported in the drill rig 14 by a boom 16 which includes a centraliser 17 for maintaining a desired position of the anchor rod 11 during drilling.

Figure 4:
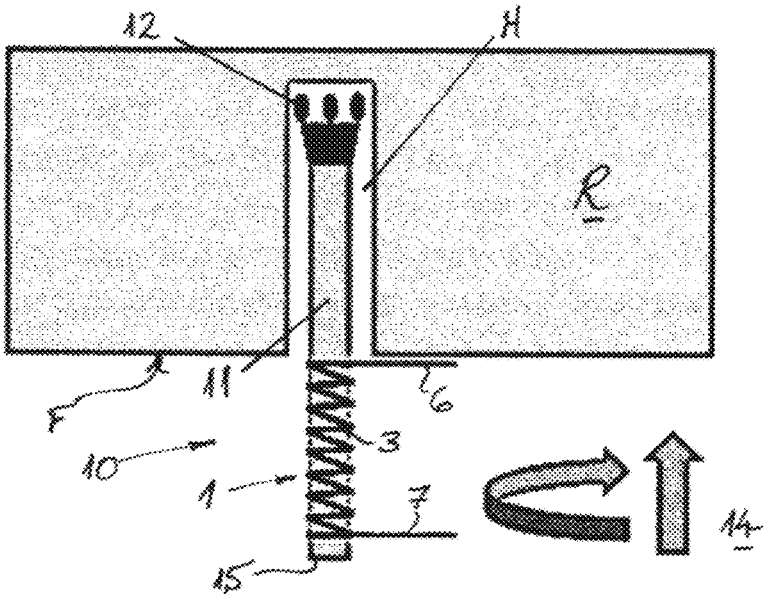
FIG. 4 is a schematic side view of a rock anchor system as shown in FIG. 3 during one stage of its installation.
Figure 5:
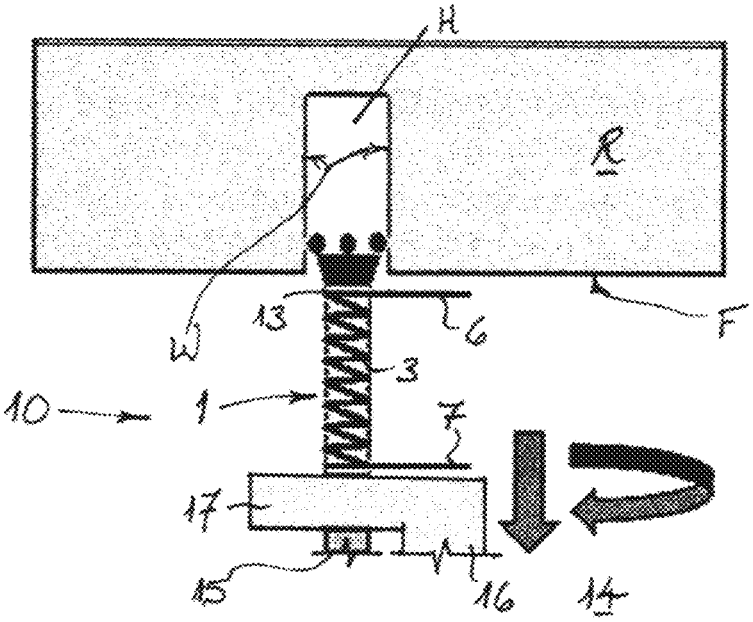
FIG. 5 is a schematic side view of the rock anchor system shown in FIG. 3 during another stage of its installation.
Figure 6:
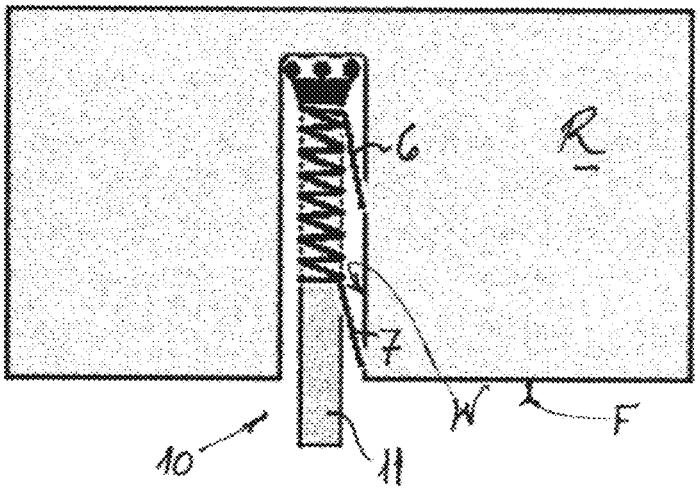
FIG. 6 is a schematic side view of the rock anchor system shown in FIG. 3 during a further stage of its installation.

With reference now to FIGS. 4 to 6 of the drawings, the operation and use of the retainer device 1 and the rock anchor system 10 of this embodiment will be explained. In use, the drill bit 12 on the end of the anchor rod 11 supported in the drill rig 14 is brought to the rock face F and the drill rig 14 is operated to rotate and advance the anchor rod 11 and drill bit 12. In doing so, the drill bit 12 drills a bore or hole H into the rock R and the retainer device 1 is able to move relative to the anchor rod 11 along the axial extent of the anchor rod 11 away from the drill bit 12, as shown in FIG. 4. In particular, when the first arm or tab 6 engages the rock face F, the rotation of the anchor rod 11 by the drill rig 14 occurs relative to the retainer device 1, which is not fixed to the anchor rod, but rather freely movable in its threaded engagement. Thus, frictional interference at the rock face F causes the anchor rod 11 to rotate relative to the retainer device 1 and the retainer device 1 is then caused to migrate (relatively) along the longitudinal extent of the anchor rod 11 due to the interaction between the helical screw thread on the outer periphery of the anchor rod 11 and the internal profile of the channel 5 formed by the coil 3 of body portion 2.

Once the hole H has been drilled to a sufficient depth for a single anchor rod 11—i.e. with just sufficient length of the rod 11 protruding from the hole H at the rock face F to perform tensioning and securing—the rotation and percussive advancement of the drill bit 12 is halted and the drill rig 14 is operated to rotate the anchor rod 11 and drill bit in the opposite direction as the anchor rod 11 is retracted or withdrawn from the hole H. This causes the retainer device 1 (i.e. via the coil 3 of the body portion 2) to migrate relative to the anchor rod 11 back to a position close to the end 13 adjacent the drill bit 12, as can be seen in FIG. 5. Like the rock face during the drilling step, the centraliser 17 located on the boom 16 of the drill rig 14 also acts as a stop for the retainer device 1 as it moves relatively along the length of the anchor rod 11.

As can be seen with reference to FIG. 6, the anchor rod 11, with the drill bit 12 and retainer device 1 mounted thereon, is then driven into the drilled hole H via the drill rig 14 with an essentially linear or axial movement or thrust. The retainer device 1 is essentially fixed or held against translational movement along the length of the anchor rod 11 when the anchor rod 11 and retainer device 1 are driven into the hole H. This is due to the interaction and interference between the helical screw thread on the outer periphery of the anchor rod 11 and the internal profile of the channel 5 formed by the coil 3 of body portion 2. As a result, the arms or tabs 6, 7 deform both resiliently and plastically to engage and bear against an inner wall W of the hole H for retaining or holding the anchor rod 11 in the hole H, as seen in FIG. 6. Indeed, this interaction between the locking arms or tabs 6, 7 and the side walls W of the hole H is easily sufficient to prevent the anchor rod 11 from falling out of the vertical hole H under self-weight. The locking arms or tabs 6, 7 may be readily designed to resist a pull-out force up to an order of magnitude greater than the forces it can be expected to need to withstand in use.

In this way, the retainer device 1 acts to retain or hold the anchor rod 11 of the rock anchor system 10, especially a self-drilling anchor, in the vertically drilled "up-hole". This allows an operator to disconnect the proximal end 15 of the anchor rod 11 from the drill rig 14 and to couple or connect the distal end 13 of a second anchor rod 11' to the proximal end 15 of the anchor rod 11 driven into the hole H. The anchor rods 11, 11' are of basically the same dimensions and are securely and rigidly coupled or connected in substantial axial alignment. Before securely coupling the two anchor rods 11, 11' together, a second retainer device 1' is mounted on an outer periphery of the second anchor rod 11' in the same way as before. After coupling, the drilling may then continue by rotating the securely coupled anchor rods 11, 11' to drill the anchor rods further into the rock strata R to extend the hole H for receiving and securing the anchor rods. The second retainer device 1' is movable relative to the second anchor rod 11' outside of the hole H and migrates along the length of the second anchor rod 11' under rotation, as before. When the hole H is sufficiently deep for the two anchor rods 11, 11', the rotation and percussive advancement of the drill bit 12 is again halted and the drill rig 14 is operated to rotate the anchor rods 11, 11' and drill bit 12 in the reverse direction as the anchor rods 11, 11' are retracted or withdrawn from the hole H. This causes the second retainer device 1' (i.e. again via the coil of the body portion) to migrate relative to the anchor rod 11' back to a position close to the distal end 13.

Figure 7:
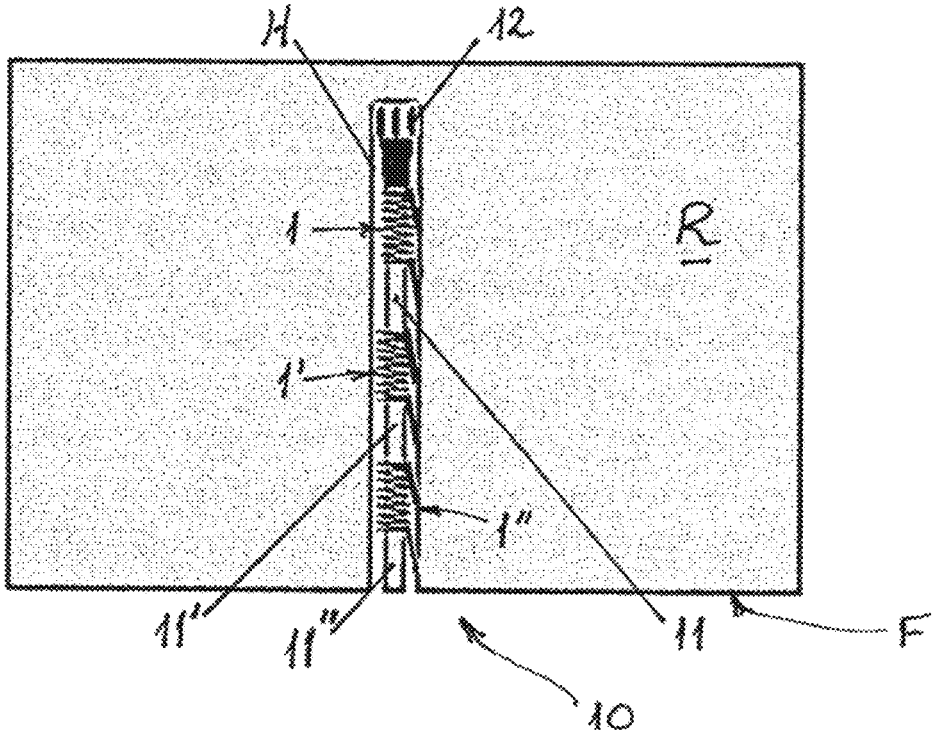
FIG. 7 is a schematic side view of a rock anchor system according to another preferred embodiment of the invention during installation.

It will be noted that the first retainer device 1 already within the hole H will remain more-or-less stationary bearing against the wall W of the hole H as the hole is drilled deeper. This is because, as the coupled anchor rods 11, 11' are rotated and advanced during drilling, the first retainer device 1 will again migrate (relatively) along the length of the first anchor rod 11. Similarly, when the coupled anchor rods 11, 11' are retracted, the reverse rotation will also allow relative migration of the first retainer device 1 without too much actual movement in the hole H. Naturally the retainer device 1 already deployed in the hole H would, to some extent, act to resist the retraction of the coupled anchor rods 11, 11' and could be damaged during that retraction. This is inconsequential, however, firstly because the retraction force that can be applied by the drill rig 14 is far in excess of the resistance force offered by the first retainer device 1, and secondly because the first retainer device 1 has already performed its function of retaining and supporting the first anchor rod 11 in the hole H during the coupling or connection of the second anchor rod 11'. Now the second retainer device 1' will retain and hold both of the anchor rods 11, 11' in the hole H during connection of a third anchor rod 11", as seen in FIG. 7.

In this regard, when the coupled anchor rods 11, 11' are driven back into the hole H via a linear thrust imparted by the drill rig 14, the second retainer device 1' is essentially fixed or held against axial movement along the second anchor rod 11' by the interaction of the coil body portion and external thread, as before. Thus, the first and second locking arms or tabs of the second retainer device 1' deform as shown in FIG. 6 to engage and bear against the wall W of the hole H to retain or hold the coupled anchor rods 11, 11' in the hole H under their self-weight, while a third anchor rod 11" may be connected.

Each of the anchor rods 11, 11', 11" is typically of about 2.5 metres or 3 metres in length and is hollow or includes a longitudinal channel or conduit for injecting cement grout or resin. Thus, once the hole H is sufficiently deep and sufficient lengths of anchor rods 11, 11', 11" have been inserted, the cement grout or resin is injected through the hollow anchor rods into the hole H to fix the anchor rod in the hole. After the resin or grout has been allowed to cure; the coupled anchor rods 11, 11', 11" may optionally be tensioned at the free or proximal end region 15 of the last anchor rod 11" outside the hole H adjacent the rock face F. A plate and nut fixture (not shown) may then be installed on the exposed end of the tensioned anchor rods at the rock face F.

Figure 8:
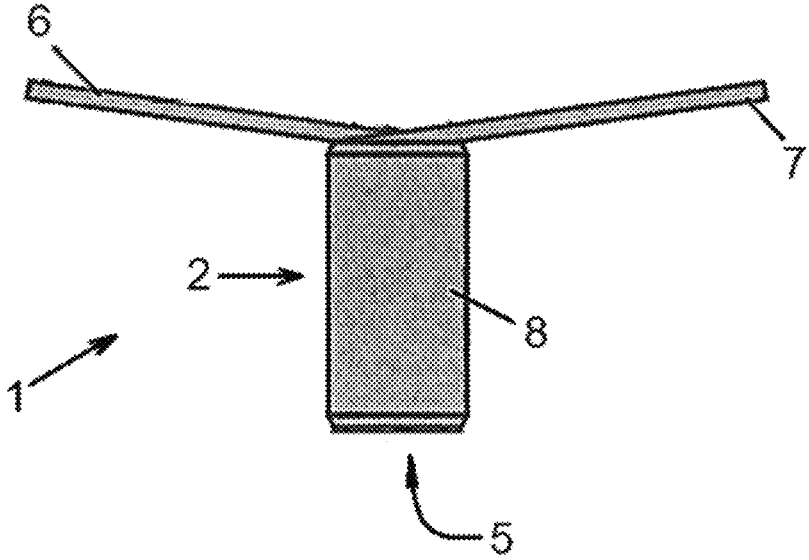
FIG. 8 is a schematic side view of a retainer device according to a further preferred embodiment of the invention.

Referring now to FIG. 8 of the drawings, an alternative embodiment of a retainer device 1 is shown schematically. The retainer device 1 of this embodiment comprises a body portion 2 in the form of a generally cylindrical sleeve 8 configured to be mounted on an outer or external periphery of an anchor rod 11. In this embodiment, the retainer device 1 again comprises two locking arms or tabs 6, 7 that project outwardly from the body portion 2 like prongs, but this time from the same end region of the body portion 2. As was the case for the above described embodiments, the retainer device 1 of this alternative embodiment is preferably fabricated from a robust metal, such a steel, and the arms or tabs 6, 7 are preferably formed integrally with the body portion 2. That is, the arms or tabs 6, 7 may comprise strip-like elements of steel and may be integral with the cylindrical sleeve 8 of the body portion 2. Although the body portion 2 in this embodiment is in the form of a sleeve 8, it could also be formed as a helical coil similar to the embodiments described above without really altering its mode of operation. In that case, for example, two lengths of wire could be coiled together (e.g. in a double helix) to form the body portion, with an end portion of one length forming a first locking arm 6, and an end portion of the second length forming the second locking arm 7 at the same end of the body portion 2.

In this alternative embodiment of the retainer device 1 shown in FIG. 8, instead of the body portion 2 having a profile configured to engage and interact with the external helical thread of the anchor rod 11, the sleeve-like body portion 2 defines a generally cylindrical channel 5 presenting a smooth profile configured to fit over the thread of the anchor rod 11. In particular, the inner periphery or diameter of the channel 5 may be sized to fit over the crests of the helical threads either in a light interference fit or in a clearance fit (i.e. with clearance or 'play'). In the case of a light interference fit, the body portion 2 of the retainer device will be lightly held by the outer periphery of the anchor rod 11 but may move or slide in axial translation in relation to the anchor rod 11 upon the application of sufficient force. In the case of a clearance fit, the inner profile of the channel 5 will be sized to fit over the outer periphery of the anchor rod 11 with room (e.g. a uniform clearance around the anchor rod in the range of 1 mm to 5 mm, and preferably 2 mm or 3 mm) for easy sliding translational movement relative to the anchor rod 11. It will be noted that the retainer device 1 of this embodiment need not be used with a threaded anchor rod 11, as the profile of the channel 5 formed by the body portion sleeve 8 is in any case not designed or intended for engagement with any thread. Instead, the retainer device 1 of this embodiment is configured for sliding movement relative to the anchor rod. As already noted above, however, provided the channel 5 it forms is appropriately sized, a helical coil 3 may also provide sliding translational movement relative to the anchor rod.

Figure 9A:
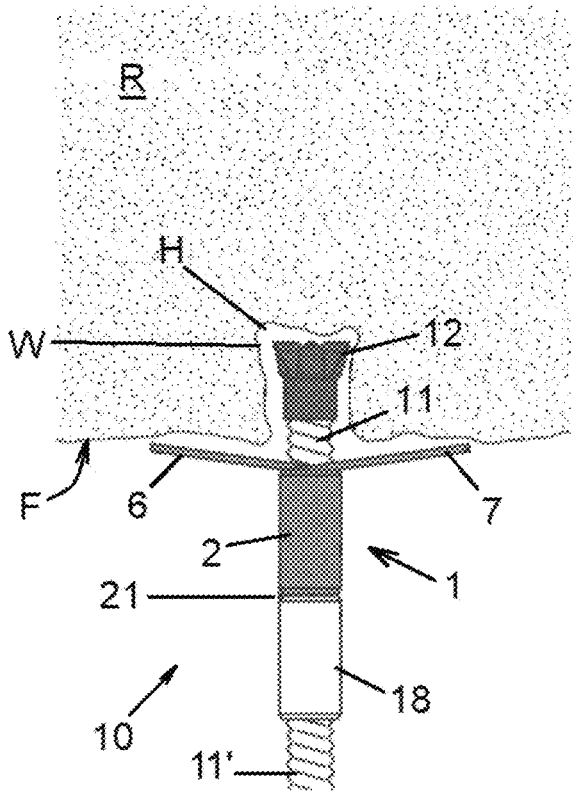
FIG. 9*a* is a schematic side view of a rock anchor system according to another preferred embodiment of the invention, having a retainer device as shown in FIG. 8, prior to advancement of the retainer device into the hole.
Figure 9B:
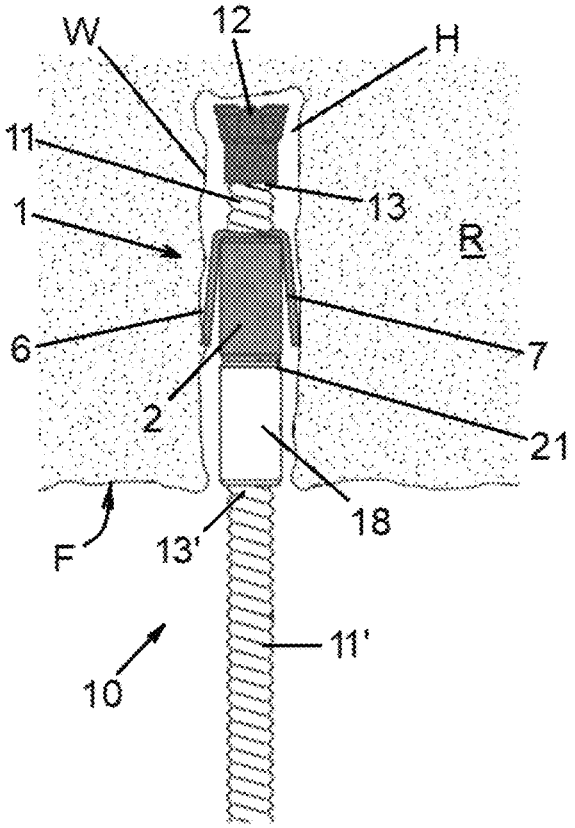
FIG. 9*b* is a schematic side view of the rock anchor system shown in FIG. 9*a* after advancement of the retainer device into the hole.

With reference now to FIG. 9*a* and FIG. 9*b* of the drawings, an embodiment of a rock anchor system 10 incorporating the retainer device 1 of FIG. 8 is shown, in which channel 5 through the body portion 2 has a profile that preferably provides a slight clearance fit (i.e. a little 'play') with the outer or external periphery of the anchor rod 11. The rock anchor system 10 also includes a drill bit 12 attached at a distal end 13 of the anchor rod 11, and a coupling member 18 attached to a proximal end 15 of the anchor rod opposite the end to which the drill bit 12 is attached. The coupling member 18 has an internal thread that matches the outer thread of the anchor rod 11 and is designed for securely joining or coupling a further anchor rod 11' to extend the length of the rock anchor system 10. That is, the coupling member 18 has a generally tubular form with a threaded interior passage 19 for interconnecting a proximal end 15 of the first anchor rod 11 with a distal end of a second anchor rod 11' in substantial axial alignment. The outer periphery 20 of the coupling member 18 is naturally therefore of greater diameter than the anchor rods 11, 11' and so projects radially outwards of the anchor rods 11, 11' that it inter-connects. In this way, coupling member 18 presents a shoulder 21 that extends radially beyond the outer periphery of the anchor rod 11 and at least part of the shoulder 21 forms an abutment for the body portion 2 (i.e. sleeve 8) of the retainer device 1. That is, the shoulder 21 presents an abutment surface facing toward the distal and 13 of the drill rod 11 for contact with a facing end of the body portion 2, as the retainer device 1 is mounted on the anchor rod 11 between the coupling member 18 and the drill bit 12.

Referring further to FIGS. 9*a* and 9*b* of the drawings, the operation and use of the retainer device 1 in the rock anchor system 10 of this embodiment will be explained. In using the rock anchor system 10 to install a rock anchor, the drill bit 12 on the distal end of the anchor rod 11 is brought into contact with the rock face F by a drill rig (not shown, but typically a hydraulic and percussive drilling rig—i.e. a "jumbo" rig—mentioned earlier) and the drill rig is then operated to rotate and advance the anchor rod 11 and drill bit 12. In doing so, the drill bit 12 drills a bore or hole H into the rock R. As the anchor rod 11 rotates and advances into the hole H during drilling, the anchor rod 11 is able to rotate relative to the retainer device 1 due to the 'play' of the clearance fit. But when sliding translational movement of the retainer device 1 relative to the anchor rod brings the retainer device 1 into abutment with the shoulder 21 of the coupling member 18, the retainer device 1 will also be advanced along with the advancement of the anchor rod 11. When the retainer device 1 then comes into contact with the rock face F (as seen in FIG. 9*a*), there will be little or no incidental co-rotation of the retainer device 1 with the anchor rod 11 due to frictional interaction with the rock face F. That is, rotating anchor rod 11 may move through the channel 5 in a sliding manner, such that the retainer device 1 migrates (relatively) along the anchor rod 11 without necessarily co-rotating. But, as the anchor rod 11 continues its advance into the hole H being drilled (i.e. moving from the position of FIG. 9*a* to the position in FIG. 9*b*), the shoulder 21 abutting the end of the cylindrical body portion 2 will continue to push or drive the retainer device 1 forward into the hole, as shown in FIG. 9*b*. In doing so, the retainer device 1 is held against further translational movement along the length of the anchor rod 11 by abutment with the coupling member 18. The ensuing advance of retainer device 1 into the hole H causes the two arms or tabs 6, 7 to deform, so as to engage and bear against an inner wall W of the hole H (as described previously) for holding the anchor rod 11 in the hole H. Specifically, when a full length of the drill rod 11 is driven into the hole H, the retainer device 1, and more particularly the locking arms or tabs 6, 7, interact with side walls W of the hole H to prevent the anchor rod 11 from falling out of the vertical hole H under self-weight. This enables the operator of the drill rig to stop drilling, to disconnect the drill rig from the anchor rod 11, and to attach a further anchor rod 11' in axial alignment via a coupling member 18 without the anchor system 10 being able to drop out of the hole H. The drill rig can then be re-connected and drilling re-commenced to drill the hole H deeper into the rock R.

In the event that the channel 5 through the body portion 2 of the retainer device 1 does not receive the anchor rod 11 in a clearance fit, but rather in a light interference fit, then the retainer device 1 will tend to rotate with, and be advanced with, the anchor rod 11 as soon as the drilling commences. This will continue until the arms or tabs 6, 7 of the retainer device 1 come into contact with the rock face F, where the frictional resistance will then typically far exceed the light interference fit. That is, the retainer device 1 will remain at the rock face F and the anchor rod 11 will be advanced or pushed through the channel 5 in a sliding manner by the drill rig (i.e. the drill rig will quite easily overcome the resistance offered by the light interference fit as the retainer device 1 is held substantially stationary due to friction with the rock face F—as seen in FIG. 9*a*) until the shoulder 21 of the coupling member 18 comes into abutment with the end of the body portion 2. Thereafter, the retainer device 1 will then also be driven forward into the hole H by the coupling member 18 as the anchor rod 11 advances; with the arms or tabs 6, 7 again deforming as described previously; i.e. as seen in FIG. 9*b*. When the retainer device 1 is pushed into the hole H by the abutment with the coupling member 18, the frictional interference between the arms 6, 7 of the retainer device 1 and the side wall W of the hole H may act to prevent the retainer device 1 from rotating with the anchor rod 11 in the hole H. It is envisaged, however, that the interference fit between the anchor rod 11 and retainer device 1 could possibly lead to some degree of co-rotation of the retainer device 1 in the hole H—i.e. overcoming the resistance of the adjacent rock strata R to cause some co-rotation.

The embodiments described with reference to FIGS. 8, 9*a* & 9*b* have the advantage that no reversal of the drilling rotation and no retraction of the anchor rods 11, 11' is required before the or each retainer device 1 is driven into the hole H. Rather, each retainer device 1 is simply driven into the hole by the advancement of the drill bit 12 and the anchor rod 11 during the drilling procedure. The setting and curing of the rock anchor system 10 for these embodiments then occurs as described with reference to the embodiments of FIGS. 4 to 7. That is, once the hole H is sufficiently deep and sufficient lengths of anchor rods 11, 11', 11" have been inserted, a cement grout or resin is injected through the hollow anchor rods into the hole H to fix the anchor rod in the hole. After the resin or grout has been allowed to cure; the coupled anchor rods 11, 11', 11" may optionally be tensioned at the free or proximal end region 15 of the last anchor rod 11" outside the hole H adjacent the rock face F. A plate and nut fixture may then be installed on the exposed end of the tensioned anchor rods at the rock face F. In this regard, reference is now made to drawing FIG. 11.

Figure 11:
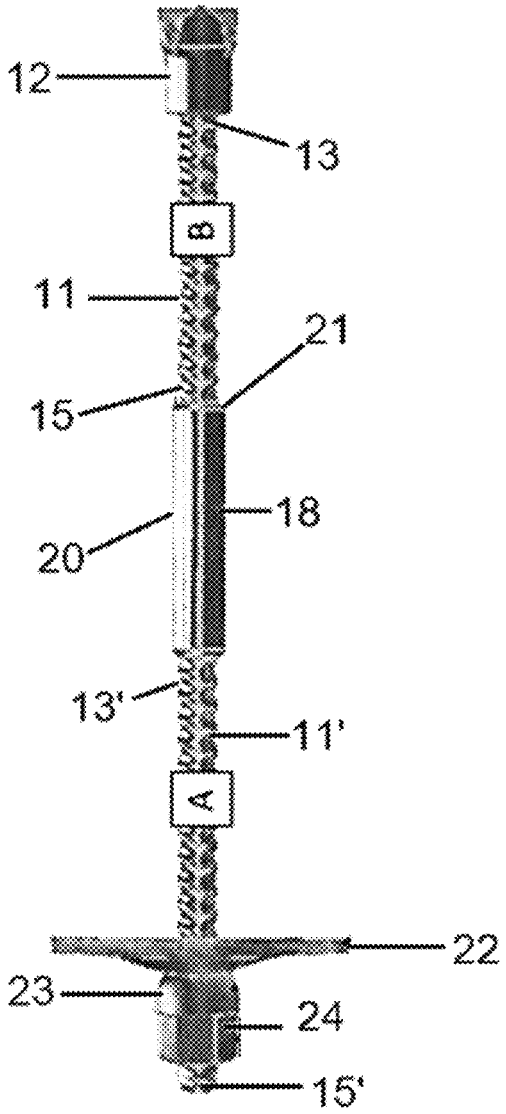
FIG. 11 is a schematic side view of an embodiment of a rock anchor system without a retainer device according to an embodiment of the invention mounted thereto.

Drawing FIG. 11 shows an example of parts of a rock anchor system 10 employing a retainer device 1 of any one of the embodiments. The parts of the rock anchor system 10 shown in FIG. 11 include two elongate anchor rods 11,11' securely coupled or joined by a threaded tube-like coupling member 18, with the two anchor rods 11,11' in substantial axial alignment. The distal end of the anchor rod 11 is provided with a drill bit 12; and the opposite (proximal) end of the rock anchor system 10 has a tensioning mechanism, comprising a bearing plate 22, dome washer 23 and threaded nut 24. In this rock anchor system 10, a retainer device 1 is mounted on the first anchor rod 11 denoted "B" in FIG. 11, on an end of which the drill bit 12 is attached. As described above, the inner periphery of the channel 5 of the retainer device 1 preferably has a clearance fit (or a light interference fit) with the outer periphery of the anchor rod 11, so that the retainer device 1 is slidable along the anchor rod 11 (if necessary, upon application of a low force). The second anchor rod 11' in the rock anchor system 10 is denoted "A" in FIG. 11. Typically, the length of the second anchor rod 11' would be substantially longer than the first anchor rod 11, which is used to locate the retainer device 1 in abutment with the coupling member 18 when the rod is installed in the hole H. For example, in a preferred embodiment, the length of anchor rod "A" may be about 2.5 m and the length of "B" may be about 0.5 m (providing for a ratio of A:B of 5:1), although other arrangements are possible.

Once this rock anchor system is installed in the hole H, the retainer device will act to prevent the rock anchor system falling out under self-weight, such that the drill rig can move onto installing another rock anchor elsewhere, and the rock anchor system can subsequently be grouted or resin-cured in place within the hole. Once the grout or resin has cured, another rig can be brought into place to tension the rock anchor system 10 via the tensioning assembly comprising bearing plate 22, dome washer 23 and nut 24. It is envisaged that a rock anchor system 10 similar to that of FIG. 11 may be used, but with further lengths of anchor rods beyond two. Each such anchor rod would be joined by a coupling member 18, and a further retainer device 1 may be located between consecutive coupling members 18. Due to space limitations in mining operations it is further envisaged that a rock anchor system having multiple lengths of anchor rods can be assembled sequentially as the rock anchor is drilled into the strata, with the rock anchor system being held in place within the hole by the retainer device whilst an addition anchor rod is coupled to the rock anchor system via a coupling member. Further coupling devices may be mounted to the further anchor rods added to system, said further coupling devices being pushed into the hole by the further coupling members added to the system.

Figure 10:
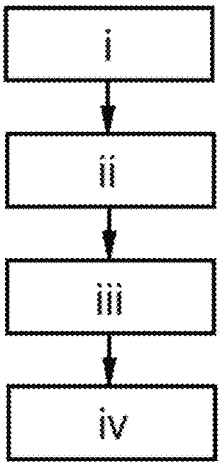
FIG. 10 is a flow diagram that schematically represents a method of installing a rock anchor according to preferred embodiments of the invention.

Finally, with reference to FIG. 10 of the drawings, a flow diagram is shown to illustrate schematically the steps in a method of installing a rock anchor in rock strata, according to the embodiments of the invention described above with respect to FIGS. 1 to 7. In this regard, the first box i of FIG. 10 represents the step of mounting a retainer device 1 on an outer periphery of an elongate anchor rod 11 of the rock anchor, the retainer device 1 having at least one arm or tab 6, 7 that projects in a direction transverse to a longitudinal extent of the anchor rod 11. The second box ii then represents the step of attaching a drill bit 12 to one end region 13 of the anchor rod 11 and rotating the anchor rod to drill the anchor rod 11 into the rock strata R to form a hole H for receiving and securing the anchor rod 11, the retainer device 1 being movable relative to the anchor rod outside of the hole H. In this regard, it will be appreciated by persons skilled in the art that the step of mounting a retainer device 1 on an outer periphery of an elongate anchor rod 11 and of attaching the drill bit 12 to the end region of the anchor rod 11 may occur simultaneously or in reverse order, before the drilling commences. The third box iii represents the step of retracting the anchor rod 11 from the drilled hole H, the retainer device 1 typically being movable relative to the anchor rod 11 outside of the hole. The fourth and final box iv in FIG. 10 of the drawings represents the step of driving the anchor rod 11 and the retainer device 1 mounted thereon into the drilled hole, H whereby the retainer device 1 is fixed or held against movement along the anchor rod 11 as the anchor rod and retainer device are driven into the hole, and whereby the at least one arm or tab 6, 7 deforms to engage and bear against an inner wall W of the hole H for retaining or holding the anchor rod in the hole.

With reference again to FIG. 10 of the drawings, the flow diagram shown can also be considered to illustrate schematically the steps in a method of installing a rock anchor in rock strata according to the embodiment of the invention described above with respect to FIGS. 8, 9*a* and 9*b*. In this regard, as noted above, the first box i of FIG. 10 represents the step of mounting a retainer device 1 on an outer periphery of an elongate anchor rod 11 of the rock anchor having a drill bit 12 attached to a distal end region 13 thereof, the retainer device 1 having at least one arm or tab 6, 7 that projects in a direction transverse to a longitudinal extent of the anchor rod 11 and with the retainer device 1 being translationally slidable relative to the anchor rod 11 along a longitudinal extent of the anchor rod. The second box ii then represents the step of rotating the anchor rod to drill the anchor rod 11 into the rock strata R to form a hole H for receiving and securing the anchor rod 11, the retainer device 1 being movable relative to the anchor rod outside of the hole H. Again, it will be appreciated by persons skilled in the art that the step of mounting a retainer device 1 on an outer periphery of an elongate anchor rod 11 and of attaching the drill bit 12 to the end region of the anchor rod 11 may occur in any order, before the drilling commences. The third box iii represents the step of an abutment 21 provided at an opposite (i.e. proximal) end region 15 of the anchor rod 11 engaging with the retainer device 1 as the anchor rod 11 slidably advances through the channel 5 of the body portion 2 as the drilling progresses. The fourth box iv of drawing FIG. 10 thus again represents the step of driving the anchor rod 11 and the retainer device 1 mounted thereon into the drilled hole H as the drilling of the anchor rod 11 advances. That is, the body portion 2—in engagement with the abutment 21 on the coupling member 18—is driven forward by the abutment 21 (i.e. in this case without a retracting step) such that the retainer device 1 is fixed or held against movement along the anchor rod 11 as the anchor rod 11 and retainer device 1 are driven into the hole, and whereby the at least one arm or tab 6, 7 deforms to engage and bear against an inner wall W of the hole H for retaining or holding the anchor rod 11 in the hole H.

Although specific embodiments of the invention are illustrated and described herein, it will be appreciated by those of ordinary skill in the art that a variety of alternative and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 retainer device
1' second retainer device
2 body portion
3 helical coil
4 wire
5 channel
6 first locking arm or tab
7 second locking arm or tab
8 cylindrical sleeve
10 rock anchor system
11 anchor rod
11' second anchor rod
11" third anchor rod
12 drill bit
13 distal end of anchor rod
14 drill rig
15 proximal end of anchor rod
16 boom
17 centraliser
18 coupling member
19 interior passage
20 outer periphery
21 shoulder
22 bearing plate
23 dome washer
24 nut
C cavity or stope
R rock strata
F rock face
A anchor
H drilled hole
W wall of hole
O ore body

The invention claimed is:

1. A retainer device for retaining or holding an anchor rod of a self-drilling rock anchor in a hole drilled above horizontal, the device comprising:

a body portion configured to be mounted on an external periphery of the anchor rod, the body portion including or defining a channel for receiving the anchor rod; and at least one arm or tab that projects outwards from the body portion in a direction transverse to a longitudinal extent of the anchor rod, wherein the body portion is, in use, configured for sliding translational movement relative to the anchor rod along a longitudinal extent thereof into engagement with an abutment on the external periphery of the anchor rod, and wherein the at least one arm or tab is configured to deform resiliently and/or plastically to engage and bear against the inner surface of the hole when the retainer device mounted on the anchor rod is driven into the hole.

2. A retainer device according to claim 1, wherein the or each arm or tab is elongate and projects from the body portion transversely to the longitudinal extent of the anchor rod by a distance at least equal to a diameter of the anchor rod.

3. A retainer device according to claim 1, wherein the or each arm or tab is configured to deform resiliently and/or plastically to engage and bear against the inner surface of the hole when the retainer device mounted on the anchor rod is driven into the hole.

4. A retainer device according to claim 1, wherein an inner periphery of the channel has or presents a profile that is configured to allow sliding translational movement along the outer or external periphery of the anchor rod in a clearance fit or a light interference fit.

5. A retainer device according to claim 4, wherein the abutment is provided on the outer or external periphery of the anchor rod for engagement with the body portion to prevents its translational movement along the anchor rod.

6. A retainer device according to claim 1, wherein the body portion comprises a coil formed of wire which defines the channel within the coil for receiving the anchor rod.

7. A retainer device according to claim 1, wherein the at least one arm or tab comprises a first arm or tab that projects from one end region of the body portion, and a second arm or tab that projects from an opposite end region of the body portion.

8. A retainer device according to claim 1, wherein the at least one arm or tab comprises a first arm or tab and a second arm or tab, wherein both the first and second arms or tabs project from the same end region of the body portion.

9. A retainer device according to claim 1, wherein the body portion and/or the at least one arm or tab is/are comprised of steel.

10. A rock anchor system, comprising:

at least one elongate anchor rod;

a drill bit configured for attachment to one end region of the elongate anchor rod for drilling the anchor rod into rock strata; and at least one retainer device according to claim 1 for retaining or holding the anchor rod in a hole drilled in the rock strata above horizontal.

11. A rock anchor system according to claim 10, wherein the at least one elongate anchor rod comprises an external helical thread formed on the external periphery of the anchor rod substantially over the longitudinal extent of the anchor rod.

12. A rock anchor system according to claim 10, wherein the anchor rod is hollow or includes a longitudinally extending channel or conduit for introducing cement grout or resin there-through into the hole drilled in the rock strata.

13. A rock anchor system according to claim 10, wherein the at least one elongate anchor rod comprises a plurality of complementary anchor rods configured to be joined or coupled together in substantial axial alignment, and wherein the at least one retainer device comprises a plurality of retainer devices.

14. A rock anchor system according to claim 13, wherein each pair of adjacent anchor rods is configured to be securely and non-rotatably joined or coupled together in substantial axial alignment by a coupling member, each coupling member having a shoulder extending radially from the outer or external periphery of the respective anchor rod for abutment with a retainer device mounted on the respective anchor rod to prevent translational movement of the respective anchor rod along the anchor rod.

15. A retainer device according to claim 1, wherein the or each arm or tab is elongate and projects from the body portion transversely to the longitudinal extent of the anchor rod by a distance in the range of 2 to 10 times the diameter of the anchor rod.

16. A retainer device according to claim 1, wherein the body portion comprises a helical coil formed of wire which defines the channel for receiving the anchor rod, and wherein the at least one arm or tab comprises: a first arm or tab that projects from one end region of the body portion and a second arm or tab that projects from an opposite end region of the body portion, wherein the first arm or tab and the second arm or tab are formed of the same wire as the helical coil.

17. A retainer device according to claim 1, wherein the body portion comprises a helical coil formed of wire which defines the channel for receiving the anchor rod, wherein the at least one arm or tab comprises a first arm or tab and a second arm or tab, and wherein both the first and second arms or tabs project from a same end region of the body portion.

18. A retainer device according to claim 17, wherein the body portion comprises two lengths of wire coiled together in a double helix, wherein an end portion of one of said lengths forms the first arm or tab, and wherein an end portion of the other of said lengths forms the second arm or tab.

19. A method of installing a rock anchor in rock strata, comprising steps of:

mounting a retainer device on an outer periphery of an elongate anchor rod of a rock anchor, the retainer device having at least one arm or tab that projects in a direction transverse to a longitudinal extent of the anchor rod;

attaching a drill bit to one end of the anchor rod and rotating the anchor rod to drill the anchor rod into the rock strata to form a hole for receiving and securing the anchor rod, the retainer device being movable relative to the anchor rod outside of the hole; and driving the anchor rod and the retainer device mounted thereon into the drilled hole, whereby the retainer device is fixed or held against axial movement along the anchor rod by a coupling member for axially connecting the said anchor rod with a second elongate anchor rod as the said anchor rod and retainer device are driven into the hole, and whereby the at least one arm or tab deforms to engage and bear against an inner surface of the hole for retaining or holding the said anchor rod in the hole.

20. A method according to claim 19, further comprising steps of:

mounting a second retainer device on an outer periphery of the second anchor rod, the second retainer device having at least one arm or tab that projects in a direction transverse to a longitudinal extent of the second anchor rod;

securely coupling the second anchor rod to a proximal end of the said anchor rod driven into the hole, whereby the anchor rods are in substantial axial alignment, rotating the securely coupled anchor rods to drill the anchor rods further into the rock strata to extend the hole for receiving and securing the anchor rods, the second retainer device being movable relative to the second anchor rod outside of the hole; and driving the second anchor rod and the second retainer device mounted thereon into the hole, whereby the second retainer device is fixed or held against axial movement along the second anchor rod by another coupling member for axially connecting the second anchor rod with a further elongate anchor rod as the second anchor rod and second retainer device are driven into the hole, and whereby the at least one arm or tab of the second retainer device deforms to engage and bear against the inner surface of the hole for retaining or holding the coupled anchor rods in the hole.

21. A method of installing a rock anchor in rock strata, wherein the rock anchor includes a drill bit attached to one end region of an anchor rod, a member securely attached to the anchor rod spaced from the drill bit and having a shoulder extending radially beyond an outer periphery of the anchor rod, and a retainer device mounted to an outer periphery of the anchor rod between the shoulder and the drill bit, the retainer device having at least one arm or tab that projects in a direction transverse to a longitudinal extent of the anchor rod, the method comprising:

rotating the anchor rod to drill the anchor rod into the rock strata to form a hole for receiving and securing the anchor rod, wherein, as the anchor rod advances into the hole, a portion of the retainer device moves to abuts against the shoulder, which thereby push the retaining device into the hole, whereby the at least one arm or tab deforms to engage and bear against an inner surface of the hole for retaining or holding the anchor rod in the hole.

22. A method according to claim 21, further comprising:

mounting a second retainer device on an outer periphery of a second elongate anchor rod, the second retainer device having at least one arm or tab that projects in a direction transverse to a longitudinal extent of the second anchor rod; securely coupling the second anchor rod to a proximal end of the anchor rod driven into the hole via a first coupling member such that the second retainer device locates between the first coupling member and a second member attached to the second anchor rod and having a second shoulder extending radially beyond an outer periphery of the second anchor rod; and, rotating the anchor rod to drill the anchor into the rock strata to extend the hole for receiving and securing the anchor rod, wherein as the anchor rod advances into the hole, a portion of the second retainer device abuts against the second shoulder thereby pushing the second retainer device into the hole.

23. A method of installing a rock anchor in rock strata, the rock anchor comprising an elongate anchor rod having a drill bit attached at one end region thereof, the method comprising:

mounting a retainer device on an outer periphery of the anchor rod, the retainer device having at least one arm or tab that projects in a direction transverse to a longitudinal extent of the anchor rod, wherein the retainer device is translationally movable relative to the anchor rod along a longitudinal extent of the anchor rod; and rotating the anchor rod with the drill bit to drill the anchor rod into the rock strata to form a hole for receiving and securing the anchor rod;

providing an abutment at an opposite end region of the anchor rod by attaching a coupling member for securely and non-rotatably joining or coupling a second elongate anchor rod in substantial axial alignment with the said anchor rod for engagement with the retainer device as the anchor rod advances into the hole thereby to drive or push the retainer device into the drilled hole, whereby, as the anchor rod advances into the hole during drilling, the retainer device mounted thereon is driven into the drilled hole, whereby the at least one arm or tab deforms to engage and bear against an inner surface of the hole for retaining or holding the anchor rod in the hole.

24. A method according to claim 23, further comprising:

securely and non-rotatably joining or coupling a second elongate anchor rod to a proximal end of the anchor rod driven into the drilled hole in substantial axial alignment therewith;

mounting a second retainer device on an outer periphery of the second anchor rod, the second retainer device having at least one arm or tab that projects in a direction transverse to a longitudinal extent of the second anchor rod; and rotating the securely joined or coupled anchor rods to drill the anchor rods into the rock strata to extend the hole for receiving and securing the anchor rods, whereby, as the anchor rods advance into the hole during drilling, the second retainer device is driven into the drilled hole, whereby the at least one arm or tab of the second retainer device deforms to engage and bear against an inner surface of the hole for retaining or holding the anchor rods in the hole.

25. A retainer device for retaining or holding an anchor rod of a self-drilling rock anchor in a hole drilled above horizontal, the device comprising:

a body portion configured to be mounted on an external periphery of the anchor rod, the body portion comprising a helical coil formed of wire which defines a channel for receiving the anchor rod; and at least one arm or tab that projects outwards from the body portion in a direction transverse to a longitudinal extent of the anchor rod, wherein said at least one arm or tab is elongate and projects transversely from the body portion by a distance at least equal to a diameter of the body portion, said at least one arm or tab being formed of the same wire as the helical coil, wherein the channel of the body portion is configured, in use, for sliding movement along the external periphery of the anchor rod in a clearance fit or a light interference fit into engagement with an abutment on the external periphery of the anchor rod, and wherein the at least one arm or tab is configured to deform resiliently and/or plastically to engage and bear against an inner surface of the hole when the retainer device mounted on the anchor rod is driven into the hole.

26. A retainer device according to claim 25, wherein the at least one arm or tab comprises a first arm or tab and a second arm or tab, and wherein both the first and second arms or tabs project from a same end region of the body portion.

27. A retainer device according to claim 26, wherein the body portion comprises two lengths of wire coiled together in a double helix, wherein an end portion of one of said lengths forms the first arm or tab, and wherein an end portion of the other of said lengths forms the second arm or tab.

28. A rock anchor system, comprising:

at least one elongate anchor rod;

a drill bit configured for attachment to one end region of the elongate anchor rod for drilling the anchor rod into rock strata; and at least one retainer device according to claim 25 for retaining or holding the anchor rod in a hole drilled in the rock strata above horizontal.

29. A rock anchor system according to claim 28, wherein the at least one elongate anchor rod comprises a plurality of complementary anchor rods configured to be joined or coupled together in substantial axial alignment, and wherein the at least one retainer device comprises a plurality of retainer devices.

30. A rock anchor system according to claim 29, wherein each pair of adjacent anchor rods is configured to be securely and non-rotatably joined or coupled together in substantial axial alignment by a coupling member, each coupling member having a shoulder extending radially from the external periphery of a respective anchor rod for abutment with a retainer device mounted on the respective anchor rod to prevent translational movement of the respective anchor rod along the respective anchor rod.

* * * * *